US007694940B2

(12) United States Patent
Yueh

(10) Patent No.: US 7,694,940 B2
(45) Date of Patent: Apr. 13, 2010

(54) MULTI-DIRECTIONAL LIFTING APPARATUS

(75) Inventor: Ming-Chuan Yueh, Tai-bao (TW)

(73) Assignee: Shinn Fu Corporation, Tapei (TW)

( * ) Notice: Subject to any disclaimer, the term of this patent is extended or adjusted under 35 U.S.C. 154(b) by 54 days.

(21) Appl. No.: 11/942,385

(22) Filed: Nov. 19, 2007

(65) Prior Publication Data

US 2009/0127532 A1 May 21, 2009

(51) Int. Cl.
*B66F 3/24* (2006.01)

(52) U.S. Cl. ..... 254/93 H; 254/93 R

(58) Field of Classification Search ..... 254/93 H, 254/93 HP, 93 R; 137/140, 145, 212
See application file for complete search history.

(56) References Cited

U.S. PATENT DOCUMENTS 4,337,669 A * 7/1982 Chatzipetros et al. .... 73/863.11
4,359,206 A 11/1982 McCreery
4,703,916 A * 11/1987 Hung ..... 254/93 H
5,569,375 A * 10/1996 Ridgeway ..... 210/137
6,549,873 B1 4/2003 Nagai

FOREIGN PATENT DOCUMENTS

JP 06200907 A 7/1994

OTHER PUBLICATIONS

International Search Report and Written Opinion issued in related PCT Patent Application Serial No. PCT/US2008/084051, dated May 12, 2009, 10 pages.

* cited by examiner

*Primary Examiner*—Hadi Shakeri
(74) *Attorney, Agent, or Firm*—Lathrop & Gage LLP

(57) ABSTRACT

There is disclosed a jack that provides lifting from multiple orientations or directions. The jack is able to provide the lifting from these multiple orientations as fluid is continuously transferred from a reservoir to a pumping chamber to a piston chamber, regardless of the orientation or direction of the jack.

12 Claims, 6 Drawing Sheets

MULTI-DIRECTIONAL LIFTING APPARATUS

TECHNICAL FIELD

The present disclosed subject matter relates to hydraulic lifting apparatus, commonly known as jacks or lifts. In particular, the present disclosed subject matter relates to hydraulic lifting apparatus, such as bottle jacks, that are operable so as to provide lifting from multiple orientations and directions.

BACKGROUND

Conventional hydraulic jacks, that are shaped like bottles, are commonly known as bottle jacks. These bottle jacks may be designed to lift (raise) loads, for example, from a few to over 100 tons. The load is anything that is raised or lifted by the jack.

Conventional bottle jacks are problematic, in that they are only operable to provide lifting when in a single upright orientation. Accordingly, when oriented upright but tilted, lifting may be limited. Moreover, when oriented sideways or upside down, lifting is nonexistent, and the jacks are inoperable.

SUMMARY

The present disclosed subject matter improves on the contemporary art by providing jacks, for example, in the form of bottle jacks, that are operable by providing lifting from any orientation or direction. As a result, the disclosed jacks are operable in tilted, sideways and upside down orientations, in addition to the conventional upright orientation or direction. Accordingly, the utility of the jack is markedly improved, as its operability is increased.

An embodiment of the disclosed subject matter is directed to a hydraulic cylinder. The hydraulic cylinder includes an outer cylinder, an inner cylinder disposed in the outer cylinder, and a piston reciprocally mounted in the inner cylinder. The space between the outer cylinder and the inner cylinder defines a reservoir for hydraulic fluid, and the space in the inner cylinder underneath the piston defines a piston cavity for hydraulic fluid. There is at least one pump for moving hydraulic fluid from the reservoir to the piston cavity, and there is a conduit, for example, a tube, movable in the reservoir. The tube allows for the continuous flow of hydraulic fluid to the pump from the reservoir from any orientation of the hydraulic cylinder.

Another embodiment of the disclosed subject matter is directed to a hydraulic cylinder. The hydraulic cylinder includes an outer cylinder, an inner cylinder disposed in the outer cylinder, and a piston reciprocally mounted in the inner cylinder. There is a space between the outer cylinder and the inner cylinder defining a reservoir for hydraulic fluid and there is a space in the inner cylinder underneath the piston defining a piston cavity for hydraulic fluid. There is also at least one pump for moving hydraulic fluid from the reservoir to the piston cavity. Within the reservoir, and movable therein, is a tube having a first end and a second end, the first end is coupled with the at least one pump and the second end for is free for moving in the reservoir and resting at an elevation at least proximate to the lowest point in the reservoir for allowing hydraulic fluid to be continuously drawn from the reservoir, from any orientation of the hydraulic cylinder.

Another embodiment is directed to a method for jacking a hydraulic cylinder from any orientation. The method includes providing a hydraulic cylinder. The hydraulic cylinder includes an outer cylinder, an inner cylinder disposed in the outer cylinder, and a piston reciprocally mounted in the inner cylinder. There is a space between the outer cylinder and the inner cylinder, the space defining a reservoir for hydraulic fluid. There is also a space in the inner cylinder underneath the piston defining a piston cavity for hydraulic fluid. There is at least one pump for moving hydraulic fluid from the reservoir to the piston cavity. A conduit, for example, a tube, is moved within the reservoir to a point proximate the lowest elevational point in the reservoir in accordance with the orientation of the hydraulic cylinder. Hydraulic fluid is then pumped through the conduit into the piston cavity.

BRIEF DESCRIPTION OF THE DRAWINGS

Attention is now directed to the drawing figures, where like numerals or characters indicate corresponding or like components. In the drawings.

DETAILED DESCRIPTION

Throughout this document, references to directions, such as upward, downward, upper, lower, up, down, top, bottom, and the like, are made. These directional references are to typical orientations for the apparatus 20 and/or components thereof. They are exemplary only, and not limiting in any way, as they are for description and explanation purposes. In FIGS. 1, 2 and 4-6, the apparatus 20 is shown oriented with respect to a surface S.

Figure 1:
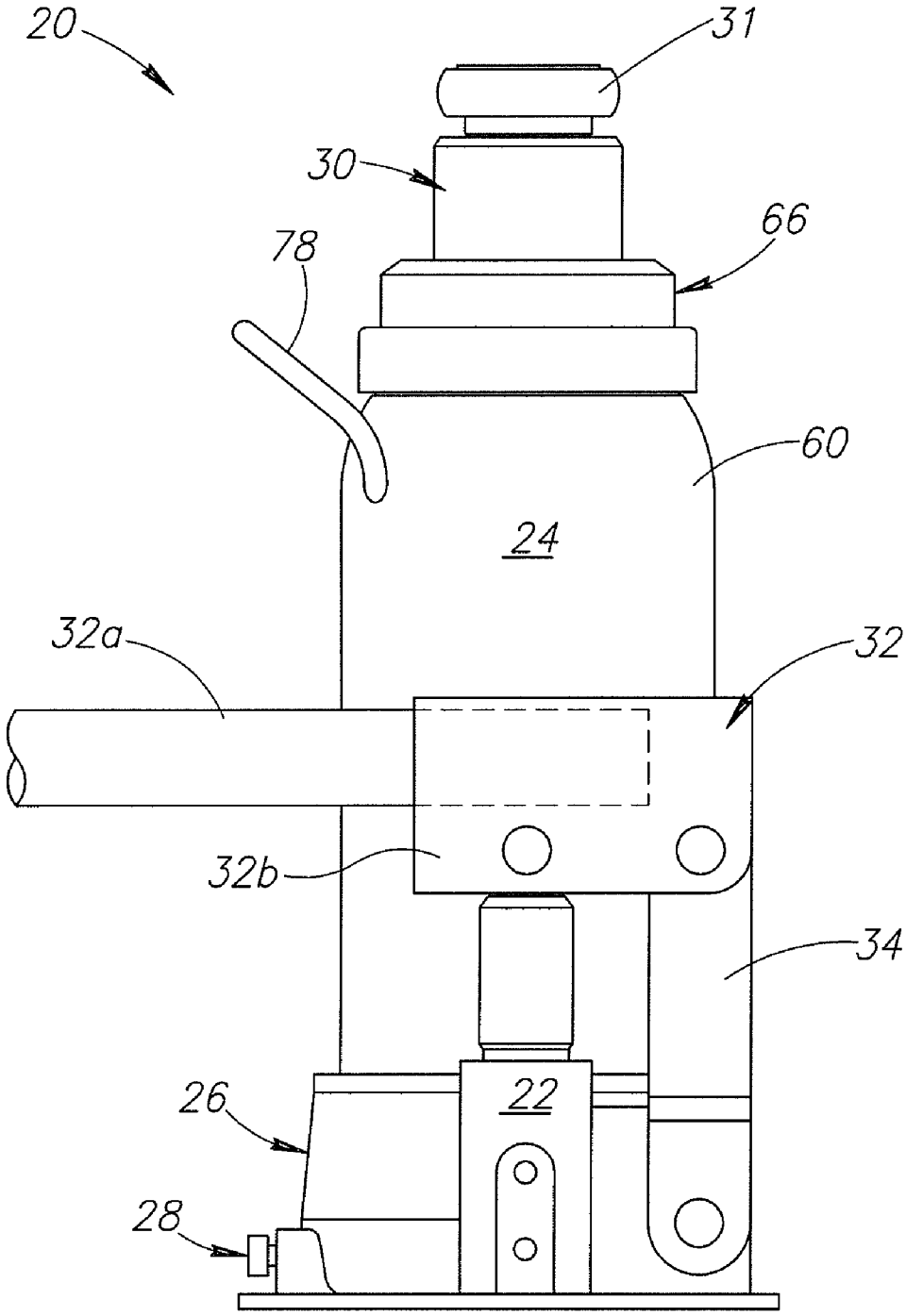
FIG. 1 is a cross sectional view of an exemplary bottle jack in accordance with the disclosed subject matter in an upright orientation.
Figure 2:
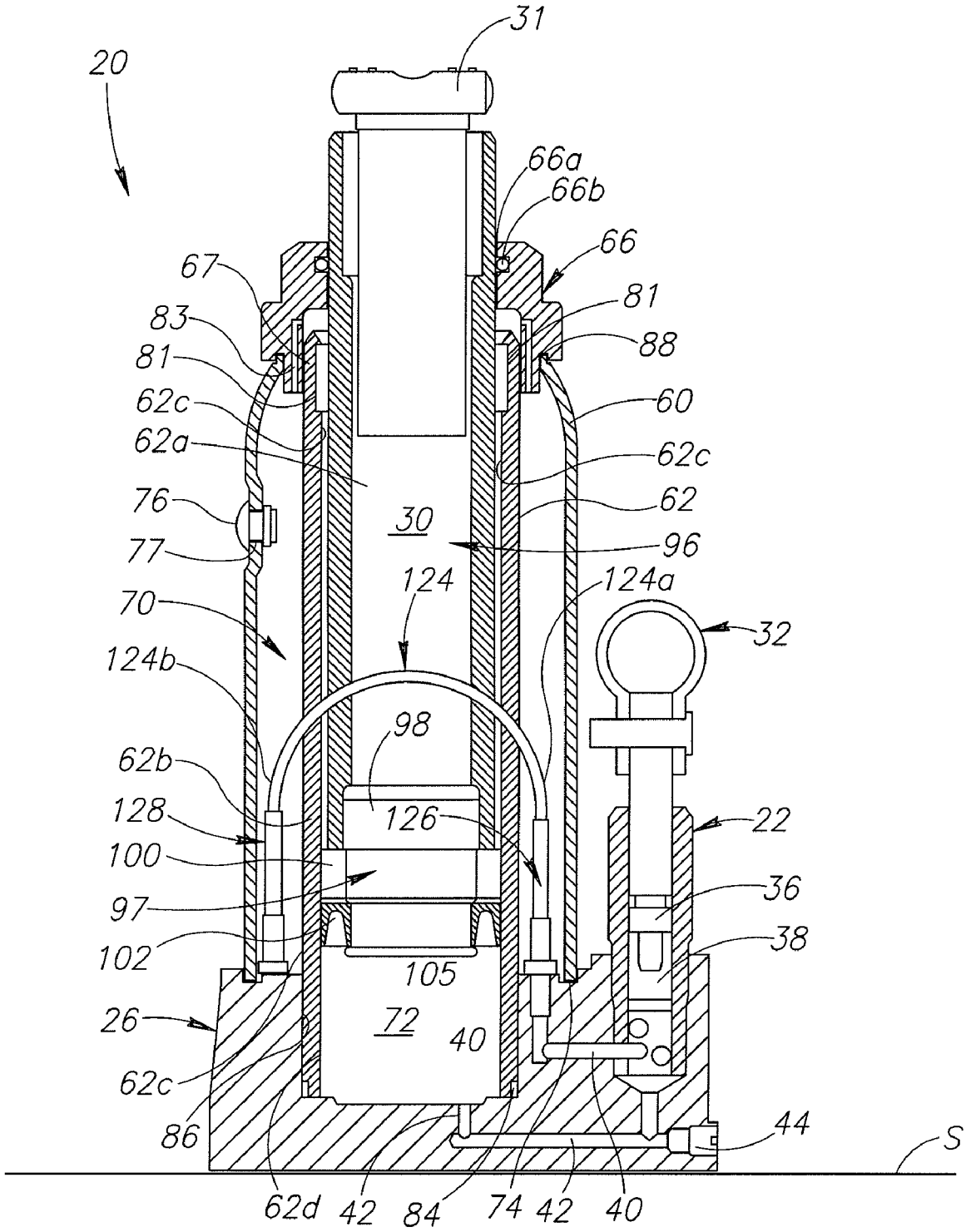
FIG. 2 is a cross sectional view of the bottle jack of FIG. 1 in a the upright orientation.

Turning to FIGS. 1 and 2, the jack apparatus 20 includes a pump unit or pump 22 and a jacking cylinder 24, supported on a base 26. The pump unit 22 and jacking cylinder 24 are connected by numerous channels for the transfer of hydraulic fluid from a reservoir 70 in the jacking cylinder 24 to the piston cavity 72 of the jacking cylinder 24 by the pump unit 22. A ram piston or ram 30, that terminates in a saddle 31, for contacting the load, is movable in the jacking cylinder, between a rest or retracted position, where the saddle 31 seats in close proximity to the open end of the jacking cylinder 24, and operative or extended positions.

The base 26 includes the channels for the transfer of hydraulic fluid (and all connections there between) associated with the aforementioned movement of hydraulic fluid through the apparatus 20, collectively referred to as the hydraulic channel system. Suitable hydraulic channel systems that may be used in the base 26 of the jack apparatus 20 include, for example, those disclosed in the Omega® Hydraulic Bottle Jacks, Model Nos. 10085C (8 Ton Capacity), 10125C (12 Ton Capacity), 10129C (12 Ton Capacity), 10205C (20 Ton Capacity) and 10209C (20 ton Capacity), commercially available from Shinn Fu Company of America, Inc., 10909 North Pomona Avenue, Kansas City, Mo. 64153, the assignee of this patent application, and disclosed in Omega® Lift Equipment, Operating Instructions and Parts Manual-Hydraulic Bottle Jacks, OIPM# 10085C-BJ2

©2002, or as disclosed in commonly owned U.S. patent application Ser. No. 11/303,586, entitled: Hydraulic Lifting Apparatus, published as U.S. Published Patent Application No. 2007/0137193 A1, all of the aforementioned disclosures incorporated by reference herein.

The base 26 also includes a release valve 28. The release valve 28 and its location is conventional, such that when activated, by a manual manipulation of the like, hydraulic fluid is released from the piston cavity 72 for return to the reservoir 70 of the jacking cylinder 24. The release of hydraulic fluid allows the ram piston 30 to move downward, from an extended position to the retracted position.

The pump unit 22 includes a handle sleeve assembly 32 (of a handle 32*a*, received in a sleeve 32*b*), that attaches pivotally to a link 34, that is attached to the base 26. The handle sleeve assembly 32 is also pivotally attached to a cylinder 36 that extends into the pump cavity 38, to draw hydraulic fluid into the pump cavity 38 from the reservoir 70 of the jacking cylinder 24, through an inflow line 40, on an upstroke, and move hydraulic fluid into the piston cavity 72 of the jacking cylinder 24 on a downstroke, through an outflow line 42. There is also a ball check valve 44, formed of a ball loaded by a spring (not shown), biased inward, that releases should the fluid pressure in the piston cavity 72 become greater than the force on the ball.

The jacking cylinder 24 includes an outer housing cylinder 60, that surrounds a piston cylinder 62. The piston cylinder 62 serves as a guide for the ram piston 30. The ram piston 30, housing cylinder 60, and, piston cylinder 62, are typically circular in cross section and of constant diameter. These cylinders 60, 62, are typically aligned coaxially. A cap 66 covers the housing cylinder 60. The cap 66 includes an opening 66*a* (with an O-ring 66*b* therein that serves as a seal), through which the saddle 31 of the ram piston 30 protrudes, and moves through upon being raised and lowered. The opening 66*a* of the cap 66 is coaxial with the ram piston 30, housing cylinder 60, and piston cylinder 62, and is of a diameter slightly greater than the diameter of the ram piston 30, to facilitate movement of the ram piston 30, when it is being raised (and the saddle 31 extended from the jacking cylinder 24) or lowered (the saddle 31 retracted into the jacking cylinder 24).

The jacking cylinder 24 and the base 26 are filled with hydraulic fluid, for example, hydraulic jack fluid or hydraulic jack oil, or the like. In the jacking cylinder 24, hydraulic fluid is stored in a reservoir 70, formed by the space between the housing cylinder 60 and the piston cylinder 62. Hydraulic fluid is also pumped into and released from a piston cavity 72, the space in the piston cylinder 62 between the base 26 and the ram piston 30. The piston cavity 72 fills with hydraulic fluid when jacking (raising of the ram piston 30) of a load is desired, raising the ram piston 30, specifically the saddle 31 from the jacking cylinder 24 to an extended position, depending on the desired lifting for the load. The reservoir 70 typically includes a filter (not shown) or the like, so that particulates in the hydraulic fluid are not pumped into the pump cavity 38 and the piston cavity 72.

The housing cylinder 60 seats in a recess 74 in the base 26. The housing cylinder 60 typically seats on a gasket 75 in the base 26. A filler plug 76 (reservoir plug or threaded filler screw), for example, a pliable rubber plug, is seated in an opening 77 in the housing cylinder 60. The filler plug 76 seals the reservoir 70 from the atmosphere (ambient environment). A handle 78 is attached to the exterior of the jacking cylinder 24, allowing for hand carrying of the apparatus 20.

The piston cylinder 62, includes a first or upper portion 62*a* and a second or lower portion 62*b*. Along the inner wall 62*c* at the first or upper portion 62*a*, are one or more hydraulic fluid return grooves 81. The grooves 81 are coupled with a passage 82, from the inside of the piston cylinder 62 to the reservoir 70, for example, over the piston cylinder 62 and through a bore 83 in the cap 66 here, to allow for fluid bypass. This fluid bypass limits the upward travel of the ram piston 30. The position (i.e., the height) of the grooves 81 determines the height that the ram piston 30 can be raised, and accordingly, prevent against explosions of the apparatus 20. This is shown, for example, and additional details of the construction of the inner wall 62*c* of the piston cylinder 62 are disclosed in commonly owned U.S. Pat. No. 5,946,912 (Hung), this patent incorporated by reference in its entirety herein. (The aforementioned structure is present in the apparatus 20 shown in FIGS. 4-6, but not shown in these drawing figures as it is not necessary to explain the operation of the apparatus 20 shown in these drawing figures).

The second or lower portion 62*b* of the piston cylinder 62 includes a threaded portion 62*d*, along the outer wall 62*e* of the piston cylinder 62. This threaded portion 62*d* is received in a correspondingly threaded portion in the base 26.

The piston cylinder 62, seats on a gasket 84 in the base 26. The piston cylinder 62 surrounds the ram piston 30 (reciprocally mounted in the cylinder 62). The base 26 also includes threaded sidewalls 86, for receiving the piston cylinder 62 at its threaded portion 62*d* (the threads corresponding to the threading of the sidewalls 86) on its outer wall 62*e*, in a frictional engagement.

The ram piston 30 includes a first or upper portion 96 and a second or lower portion 97. The lower portion 97 of the ram piston 30 receives a collar 98, a ram bearing 100, and a u-cup 102. A retainer ring 105 secures the positions of the ram bearing 100 and u-cup 102 on the lower portion 97 of the ram piston 30.

The ram bearing 100 and u-cup 102, as placed onto the second or lower portion 97 of the ram piston 30, are of a diameter greater than that of the first or upper portion 96 of the ram piston 30, and of a diameter slightly less than the internal diameter of the piston cylinder 62, to allow the ram piston 30 be frictionally snug within the piston cylinder 62, while allowing for it to move up and down within the piston cylinder 62. The ram bearing 100 and u-cup 102 are also typically of a diameter slightly greater than the opening 66*a* of the cap 66, whereby the cap 66 may serve as an upward limit of travel for the ram piston 30.

Other ram piston 30, housing cylinder 60, piston cylinder 62 and cap 66 arrangements, suitable for use as the jacking cylinder 24, include those disclosed in commonly owned U.S. patent application Ser. No. 11/303,586 (Published as U.S. Patent Application Publication No. US2007/0137193 A1), and U.S. Pat. No. 5,946,912 (Hung).

Figure 4:
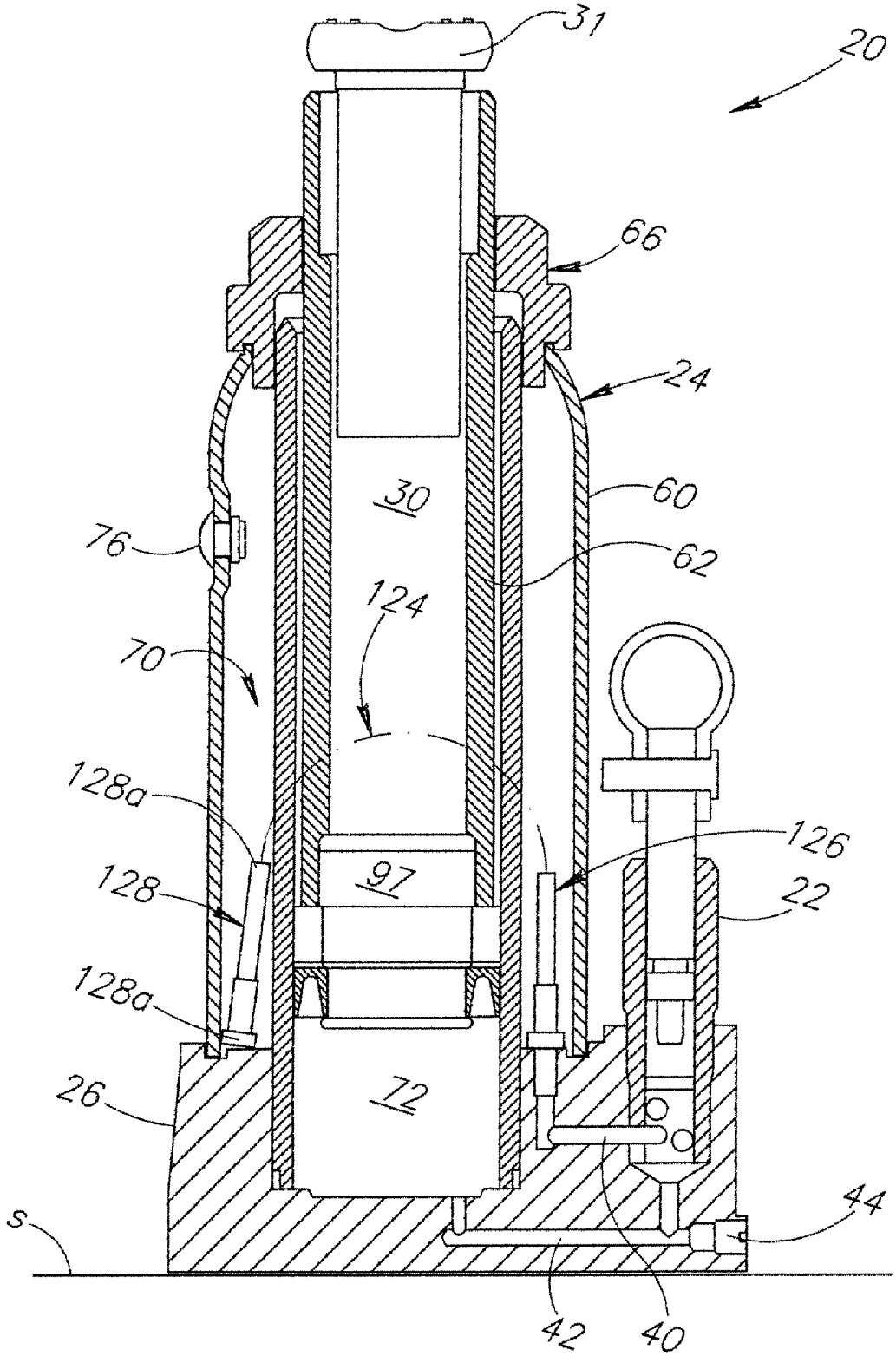
FIG. 4 is a cross sectional view of the bottle jack of FIG. 1 in a tilted or angled orientation.
Figure 5:
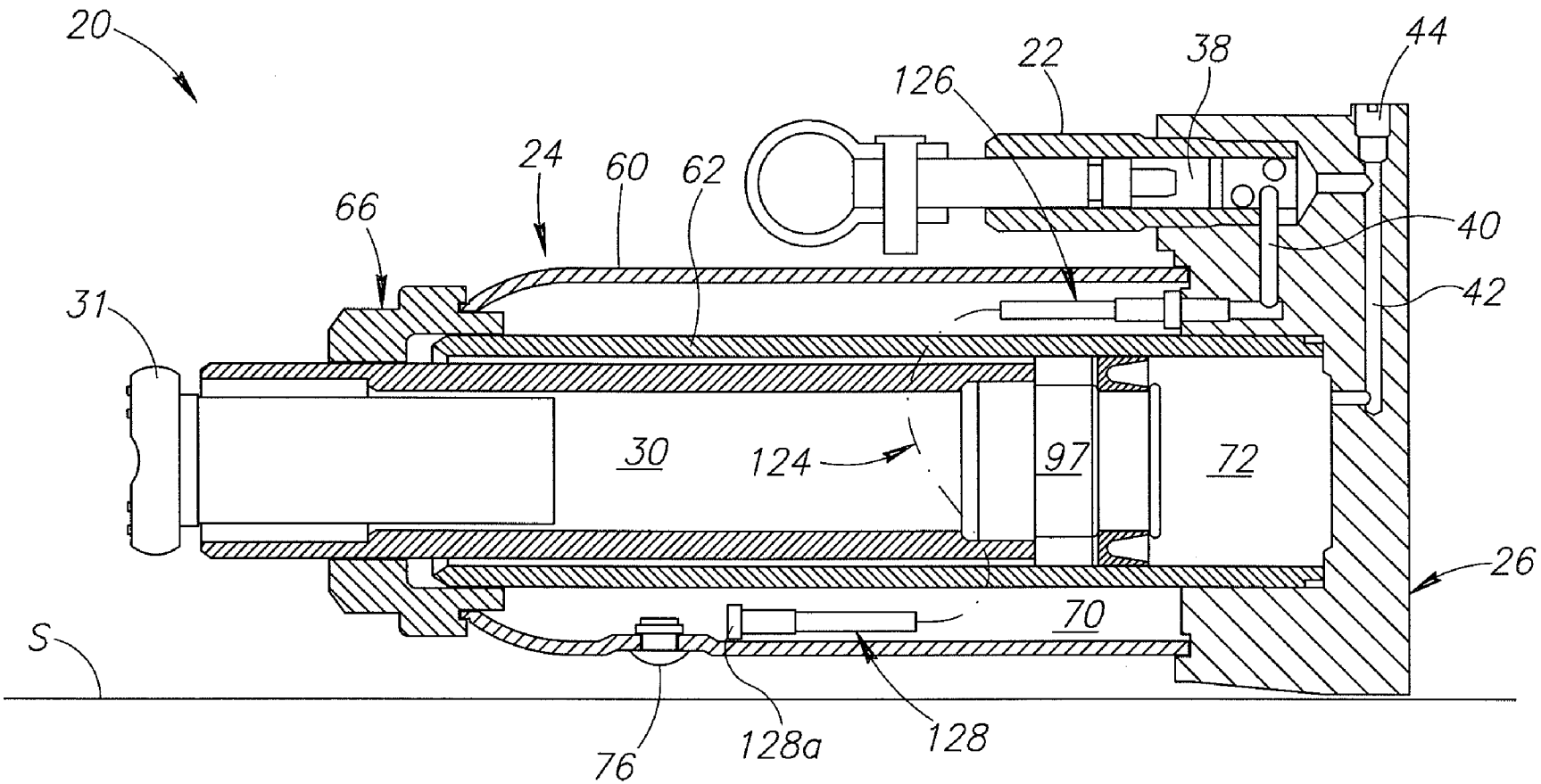
FIG. 5 is a cross sectional view of the bottle jack of FIG. 1 in a sideways orientation.
Figure 6:
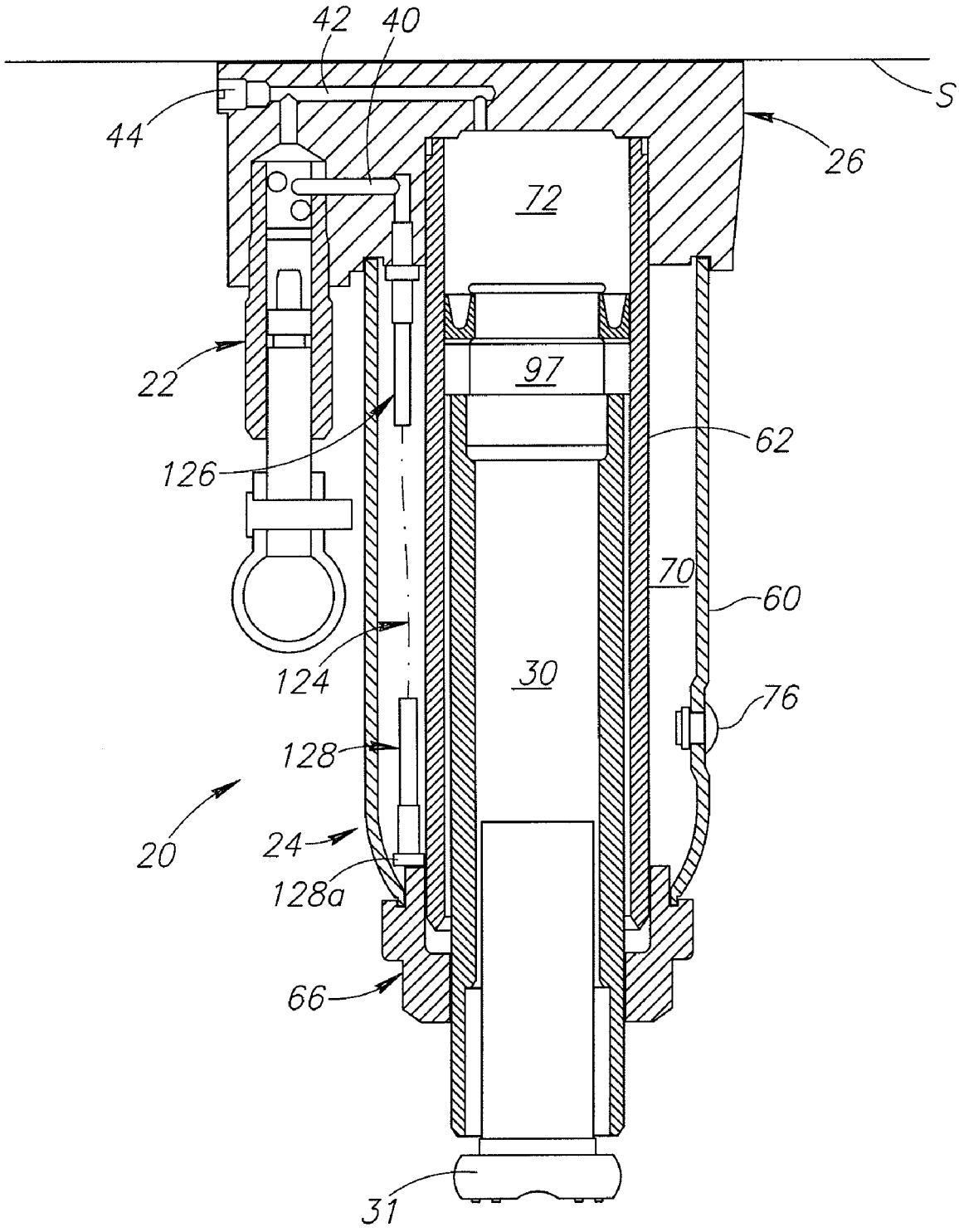
FIG. 6 is a cross sectional view of the bottle jack of FIG. 1 in an upside down or inverted orientation.

Within the reservoir 70 is a tube 124, that connects to the inflow line 40 of the base 26. The tube 124 is of a flexible material, such as a polymer, elastomer or the like. It is received and attached at one end 124*a* in a connector 126, that attaches to the inflow line 40. The other end 124*b* of the tube 124 is received in an anchor piece 128, coaxial with the tube 124. The tube 124 as shown in FIGS. 4-6 is represented by a broken line.

Figure 3:
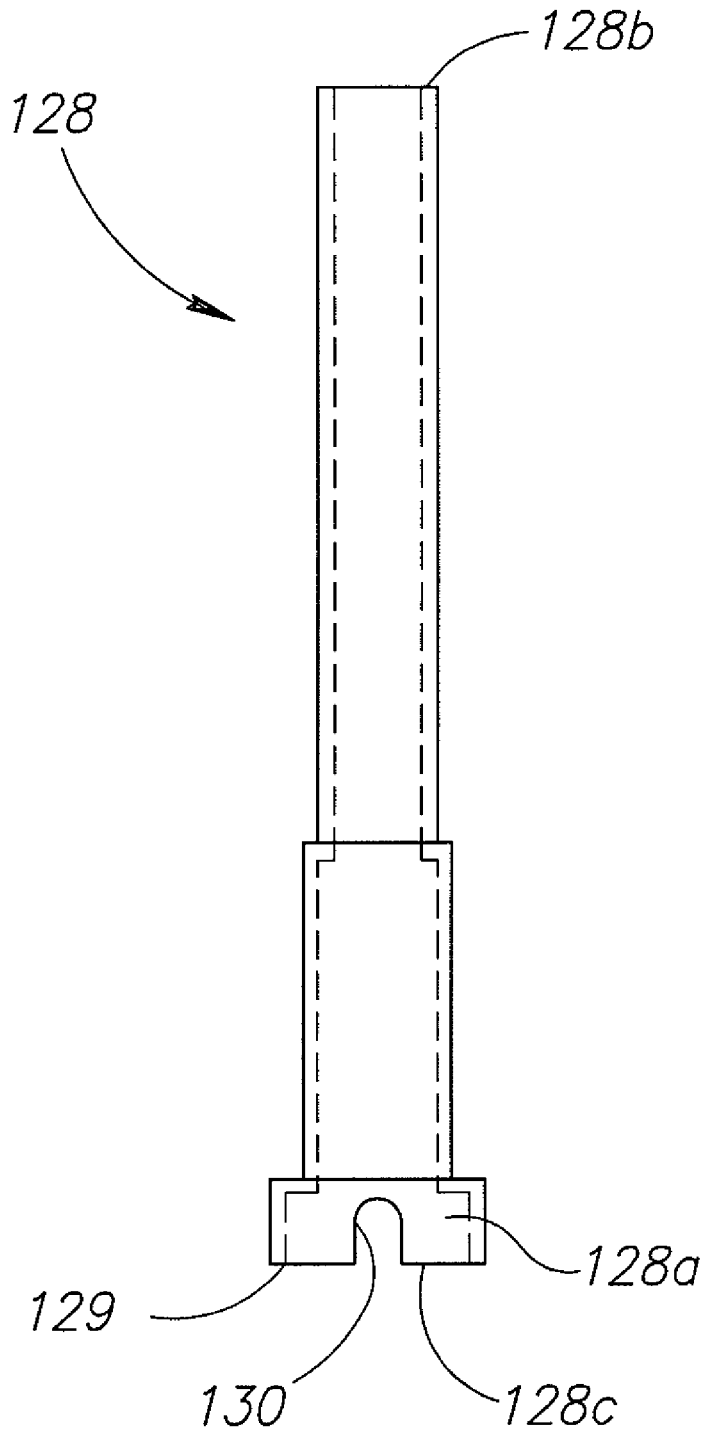
FIG. 3 is a perspective view of the free end of the tube in the reservoir of the bottle jack of FIG. 1.

As shown in detail in FIG. 3, the anchor piece 128 serves as the tip of the tube 124. The anchor piece 128 is a tube (the bore therethrough shown in broken lines) that includes an opening 129 at its free end 128*a* (at the edge 128*e*), to form the inlet opening for the tube 124. The opposite end 128*b* of the anchor piece 128 is also open, and is connected to the end 124*b* of the tube 124. This connection allows the anchor piece 128 move freely in the reservoir 70.

The anchor piece 128 is, for example, of metal, such as steel or the like, and is of a weight sufficient to sink to the lowest point in the reservoir 70, based on the orientation (direction) of the jacking cylinder 24, such that hydraulic fluid is always available to be drawn through the tube 124 by the pump unit 22, allowing the apparatus 20 to lift, in all orientations (directions).

The end 128*a* of the anchor piece 128 includes an aperture 130 cut into the anchor piece 128 for hydraulic fluid to enter the anchor piece 128 through side walls, and ultimately, the tube 124. The aperture 130 maintains fluid flow into the anchor piece 128 and tube 124 and prevents sealing from back pressure, should the edge 128*e* of the anchor piece 128 be in contact with a surface of the jacking cylinder 24 or the base 26. While a single aperture 130 is shown, multiple apertures are permissible.

For example, as shown in FIG. 2, when the apparatus 20 and in particular, the jacking cylinder 24, is in an upright orientation, the anchor piece 128 is at the lowest point of the reservoir 70. At this point, the anchor piece 128 is in contact, and typically immersed in hydraulic fluid, such that upon pumping, hydraulic fluid will be drawn into the tube 124 for transfer through the inflow tube 42 to the piston cavity 38, through the outflow line 40.

In FIG. 4, the apparatus 20 is shown in a tilted orientation or direction. The anchor piece 128 is at the lowest point in the reservoir 70, to allow for hydraulic fluid to be drawn into the anchor piece 128 and the tube 124. Similarly, in FIG. 5, the apparatus 20 is shown in a sideways orientation, whereby the anchor piece 128 is at the lowest point of the reservoir 70.

FIG. 6 shows the apparatus 20 in an inverted or upside down orientation. The anchor piece 128 is suspended in the reservoir 70 as it is at its lowest point of the reservoir 70, as held in position by the tube 124.

While preferred embodiments of the disclosed subject matter have been described, so as to enable one of skill in the art to practice the disclosed subject matter, the preceding description is intended to be exemplary only. It should not be used to limit the scope of the disclosed subject matter, which should be determined by reference to the following claims.

What is claimed is:

1. A jack apparatus comprising:

a hydraulic jacking cylinder including an outer housing cylinder;

an inner piston cylinder disposed in the outer cylinder;

a piston reciprocally mounted in the inner cylinder;

the space between the outer cylinder and the inner cylinder defining a reservoir for hydraulic fluid;

a space in the inner cylinder underneath the piston defining a piston cavity for hydraulic fluid;

at least one pump for moving hydraulic fluid from the reservoir to the piston cavity; and a conduit including a first end and a second end, the first end being open to receive hydraulic fluid, the second end being in communication with the at least one pump, the conduit being of a length sufficient for moving to low elevations in the reservoir in accordance with the orientation of the hydraulic cylinder for continuously providing hydraulic fluid to the at least one pump from the reservoir from any orientation of the hydraulic cylinder, at least one aperture extending through the conduit at the first end, wherein the conduit includes a flexible tube, wherein the tube includes a first end and a second end corresponding to the first end and the second end of the conduit, wherein the conduit additionally comprises a weighted tip at the first end of the tube for sinking the tube in the reservoir, the tip being open at an edge, wherein the second end of the tube is fixed in the reservoir and in communication with the at least one pump, and wherein the at least one aperture is positioned at and extends inward from the edge of the tip.

2. The jack apparatus of claim 1, additionally comprising:

a first channel for hydraulic fluid passage from the reservoir to the at least one pump;

a second channel for hydraulic fluid passage from the at least one pump to the piston cavity; and, the second end of the tube is in fluid communication with the first channel.

3. The jack apparatus of claim 1, wherein the inner cylinder and outer cylinder are fixed relative to each other.

4. The jack apparatus of claim 1, wherein the at least one aperture includes a plurality of apertures.

5. A jack apparatus comprising:

a hydraulic jacking cylinder including an outer housing cylinder;

an inner piston cylinder disposed in the outer cylinder;

a piston reciprocally mounted in the inner cylinder;

the space between the outer cylinder and the inner cylinder defining a reservoir for hydraulic fluid;

a space in the inner cylinder underneath the piston defining a piston cavity for hydraulic fluid;

at least one pump for moving hydraulic fluid from the reservoir to the piston cavity; and a tube including a first end and a second end, the first end in communication with the at least one pump and the second end for moving in the reservoir, the tube being of a length sufficient for moving to low elevations in the reservoir in accordance with the orientation of the hydraulic cylinder for allowing hydraulic fluid to be continuously drawn from the reservoir, the second end of the tube including a weighted tip for sinking the tube to the low elevations in the reservoir, the weighted tip being open at a distal end along a plane at an edge of the distal end to allow for fluid flow into the tube, at least one aperture extending through the second end of the tube, the at least one aperture is positioned at and extends inward from the edge of the weighted tip, wherein the tube is of a flexible material.

6. The jack apparatus of claim 5, additionally comprising:

a first channel for hydraulic fluid passage from the reservoir to the at least one pump;

a second channel for hydraulic fluid passage from the at least one pump to the piston cavity; and, the first end of the tube is in fluid communication with the first channel.

7. The jack apparatus of claim 5, wherein the inner cylinder and outer cylinder are fixed relative to each other.

8. The jack apparatus of claim 5, wherein the at least one aperture includes a plurality of apertures.

9. A jack apparatus comprising:

a hydraulic jacking cylinder including an outer housing cylinder;

an inner piston cylinder disposed in the outer cylinder;

a piston reciprocally mounted in the inner cylinder;

the space between the outer cylinder and the inner cylinder defining a reservoir for hydraulic fluid;

a space in the inner cylinder underneath the piston defining a piston cavity for hydraulic fluid;

at least one pump for moving hydraulic fluid from the reservoir to the piston cavity; and a conduit in communication with the at least one pump in the reservoir, the conduit being weighted and of a sufficient length such that the conduit moves by gravity to a low elevation in the reservoir in accordance with the orientation of the hydraulic cylinder for continuously providing hydraulic fluid to the at least one pump from the reservoir, the conduit including an opening for fluid flow into the conduit and at least one aperture extending through the conduit proximate to the opening; wherein the conduit includes a flexible tube; the tube including a first end, a second end and an anchor member; the tube first end being in communication with the at least one pump; the anchor member defining the weighting for the conduit; the anchor member including oppositely disposed first and second edges and a bore extending from the first edge to the second edge; the anchor member coupled to the second end of the tube proximate to the first edge of the anchor member, the second edge of the anchor member defining the opening for fluid flow of the conduit, wherein the at least one aperture extends inward from the second edge of the anchor member.

10. The jack apparatus of claim 9, additionally comprising:

a first channel for hydraulic fluid passage from the reservoir to the at least one pump;

a second channel for hydraulic fluid passage from the at least one pump to the piston cavity; and, the first end of the tube is in fluid communication with the first channel.

11. The jack apparatus of claim 9, wherein the inner cylinder and outer cylinder are fixed relative to each other.

12. The jack apparatus of claim 9, wherein the at least one aperture includes a plurality of apertures.

* * * * *